United States Patent [19]

Comert et al.

[11] Patent Number: 4,953,885

[45] Date of Patent: Sep. 4, 1990

[54] SKI CONSTRUCTION

[75] Inventors: Ahmet Comert, Chaineux; Michel Ladang, Herve; Dominique Petit, Housse-Blegny, all of Belgium

[73] Assignee: Norton Company

[21] Appl. No.: 111,384

[22] Filed: Oct. 21, 1987

[51] Int. Cl.[5] ..... A63C 5/00

[52] U.S. Cl. ..... 280/610; 428/347; 428/349

[58] Field of Search ..... 280/607, 610; 428/349, 428/347, 482; 156/311, 313, 182

[56] References Cited

U.S. PATENT DOCUMENTS

| | | | |
|---|---|---|---|
| 2,525,618 | 10/1950 | Pierce, Jr. | 280/610 |
| 4,146,251 | 3/1979 | Tanahashi | 280/610 |
| 4,169,822 | 10/1979 | Kutch et al. | 260/27 |
| 4,412,687 | 11/1983 | Andre | 280/610 |
| 4,495,020 | 1/1985 | Nakabayashi et al. | 428/482 |
| 4,707,269 | 11/1987 | Ohue et al. | 210/651 |
| 4,725,637 | 2/1988 | Fernyhough et al. | 525/194 |

FOREIGN PATENT DOCUMENTS 2090607 7/1982 United Kingdom .

*Primary Examiner*—David M. Mitchell
*Assistant Examiner*—Eric Culbreth

[57] ABSTRACT

Skis of laminated construction are assembled by joining the several lamellae with a hot metal adhesive which preferably contains an effective amount of an adhesion promoting agent. The hot melt adhesive is preferably a linear polyester, polyesteretheramide, polyetherester, polyamide, polyetherurethane, copolymer of ethylene-vinylacetate, polyesteramide, or polytheramide, and when the adhesve is based on a copolymer, it is more preferable still that the copolymer is a block copolymer.

8 Claims, 1 Drawing Sheet

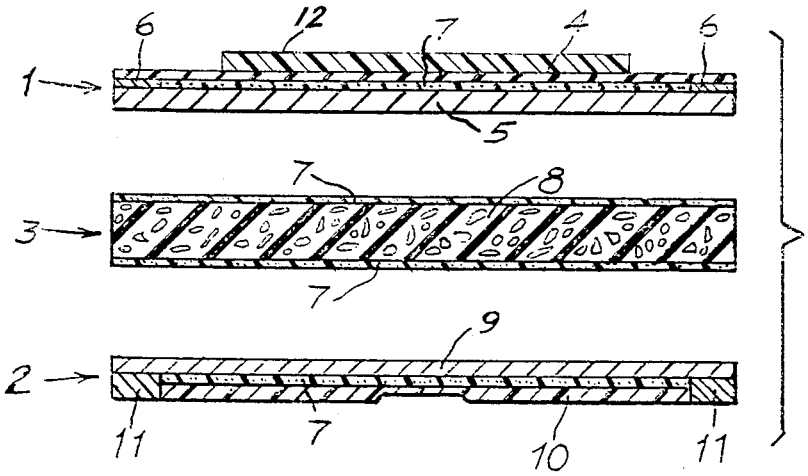
6
12
7
4
6
1
5
7
8
3
7
9
2
11
7
10
11

SKI CONSTRUCTION

TECHNICAL FIELD

The invention relates to skis and ski bindings and a method of manufacturing.

BACKGROUND AND INFORMATION DISCLOSURE STATEMENT

The following publications are representative of the best prior art known to the Applicants at the time of filing the application.

U.S. Patent Documents 4,146,251 Mar. 27, 1979 *R. Tanahashi*
4,169,822. Oct. 2, 1979 *E. F. Kutch* et al.
4,412,687 Nov. 1, 1983 *W. Andre*

Foreign Patent Documents 2,090,607A July 14, 1982 United Kingdom

Modern skis, be they water skis or skis used on snow, are of complex construction consisting of several materials laminated together. They may be considered to be made up of three sections, a top surface bearing section, a bottom surface bearing section, and a core section sandwiched therebetween. The construction may be relatively simple such as that described by the Tanahashi reference. FIG. 1A shows a laminated ski design involving a foamed polymer core 3 within an upper structure 1 and a lower structure 2. The upper structure 1 is itself made up of two layers or lamellae namely a so-called top board 11 and a plastic layer 12; similarly the lower structure 2 is made up of a sole board 21 and a plastic layer 22. Both the upper structure 1 and the lower structure 2 include edges 13 and 23 respectively which run the full length of the ski or at least the length of the ski from the rear to where the tip of the ski begins to curve in the upward direction.

FIG. 2 of the Tanahashi patent shows a somewhat more elaborate construction. This approach has upper and lower structures 1 and 2 similar to those of FIG. 1A. The center portion of the ski contains a foamed polymer core 51 composed of e.g. foamed polyurethane. On each side of the foamed polymer core 51 are adhesive layers 54 which are glass cloth epoxy resin prepregs, and strips of wood 52 and 53. The epoxy resin prepreg is heated up to 90° C. in order to activate and cure the epoxy resin thereby uniting the wood strips 52 and 53, and the foamed polymer core.

The Andre patent discloses a very complex ski design. The complexity of this ski can be best appreciated by following the assembly of the ski as taught in the patent. First two steel strips 7 are placed in a mold over which is placed an unvulcanized rubber strip or layer 4 1–2 mm thick and containing several steel cords 6; a glass fabric (not shown) is placed over the rubber layer and the rubber is then vulcanized under ordinary vulcanizing conditions. In a similar manner an identical steel cord reinforced rubber strip 5 is placed in a second mold on two aluminum strips 8 which function as top edge protectors and is then covered with a glass cloth layer and vulcanized. The first laminate is then placed in the bottom of the final ski mold and on the upper side of the glass fabric, four layers of unidirectional epoxy impregnated glass filament bundles 11 are positioned in the longitudinal direction of the ski. A core layer is then built up consisting of three balsa wood strips 1 laid parallel to each other between which are located prehardened walls 10 of a glass fiber-epoxy resin composite. Between and surrounding the strips 1 is wrapped an epoxy impregnated glass cloth. Around this core another epoxy impregnated glass cloth 3 is wrapped; the core is further built up with six additional layers of epoxy impregnated glass cloth. A precured or prevulcanized rubber like layer 5, including edges 8 and a glass fiber anchoring fabric, is placed on the core layer. The mold is then closed on the entire conglomeration which is then heat treated in the conventional manner to cure the epoxy resin adhesive thus binding everything into the final ski configuration. The thus formed ski is removed from the mold. The final touches are then accomplished on the ski namely adhering to the bottom surface a low friction runner 12 made of, for example, polyethylene; and adhesively attaching to the top surface, a finishing layer or film such as colored film of acrylonitrile-butadiene-styrene foil which may also include a decorative design thereon.

As can be seen from the foregoing discussion of the Tanahashi and Andre patents, thermoset epoxy resins are used as the adhesive for joining together various lamellae and/or the elements making up the lamellae. The ski fabricating industry also uses cyano-acrylate based adhesives to fasten the boot or foot pad to the upper surface of the ski or to the base of the binding which is usually painted metal. The pad is generally a metal piece, polytetrafluoroethylene coated metal piece, or it may be composed entirely of that polymer. While the laminated ski was a major technical advancement in skiis and the epoxy and cyano-acrylate adhesives a major contributor to that advancement, epoxy and cyano-acrylate bonded skiis do have their problems. Because of the physical and chemical nature of these polymers they are susceptible to deterioration, and failure, from the frequent temperature changes to which they are exposed, as well as an extremely high level of moisture. In addition, both adhesives are inherently brittle, which is obviously not a desirable attribute when used in a ski which is under constant flexing conditions in use. Epoxy adhesives also require a long curing time, e.g. 30 minutes which substantially adds to the fabricating costs.

It is these problems which the present invention overcomes.

Also relevant to the present invention is the United Kingdom patent to Borg listed above. It is relevant because it describes a thermofusible polymeric adhesive, i.e. a hot melt adhesive, of the type that plays a critical role in the present invention. In the same vein, the Kutch et al. patent discusses, inter alia, the addition of adhesion promoters such as silanes to hot melt adhesives and rubbers.

DISCLOSURE OF THE INVENTION

The ski of the present invention, like the majority of modern skiis, is a composite structure made up of a top surface bearing section, a bottom surface bearing section, and a core section sandwiched therebetween. Generally each section is made up of several elements or parts but this is not necessary. The sections and their elements are bonded together with a hot melt adhesive which contains an effective amount of an adhesion promoting agent and preferably the surfaces are coated with a primer. The result is a ski which will survive the extreme conditions of temperature fluctuations and exposure to moisture much longer than will a ski in which the sections and elements have been bonded with epoxy and the boot pad with cyano-acrylate based adhesives. In addition, if the boot pad is made of polytetrafluoroethylene or is coated with that material, as compared to uncoated steel or aluminum, the cyano-acrylate more quickly becomes brittle and fails.

While hot melt adhesives based on almost any of the thermoplastic polymers used for that purpose will work, there are several preferred thermoplastic polymer types. Especially effective are polyester, polyamide, polyesteretheramide, polyetherester, polyetherurethane, polyesteramide, polyetheramide, and copolymers of ethylene-vinyl acetate or mixtures thereof.

An effective amount of an adhesion promoter must be added to one of the foregoing thermoplastic polymers. By an effective amount is meant from 0.05 to 200 parts by weight of adhesion promoter for each 100 parts by weight of thermoplastic polymer. Adhesion promoters include epoxy resins, phenolic resins, urethane polyesters, polyethers, and organo substituted silanes. The preferred adhesion promoter is one selected from a long list of organo substituted silanes such as A-186, A-187, A-1100 and A-1120 all manufactured and sold by Union Carbide Corporation. The selection of any given silane is dependent on the substrates being bonded.

While the main constituents of hot melt adhesive utilized in the invention are the thermoplastic polymer and the adhesion promoter, the system is amenable to the addition of other materials if there is a need. For example, fillers such as carbon black, titanium dioxide, silica flour, talc, calcium carbonate, clay and the like may be added. Also, tackifiers and plasticizers may be blended into the polymer-adhesion promoter formulation if there is a need for more room temperature flexibility and room temperature tackiness. To enhance the adhesive's resistance to oxidation it is recommended that an antioxidant be included in the adhesive composition. An example of an especially suitable antioxidant is pentaerythrityl-tetrakis [3-(3, 5, ditertiary butyl - 4 - hydroxyphenyl)-proprionate known by the trademark Irganox 1010 sold by Ciba-Geigy.

To attain the ultimate adhesive joint between some substrates a primer applied to the substrate may be necessary, in conjunction with the normal practice used in adhesive bonding i.e. the cleaning of all surfaces to be joined and in the case of metals which are prone to have oxide coatings thereon that are not strongly coherent, the coating should be removed by acid treatment, shot or sand blasting, or the like. The primer must have good adhesion to both substrates or adherends if it's to function as an effective bridge and improve the adhesion of the adhesive. Primers are generally polymers dissolved in a solvent and therefore wet surfaces more easily and completely than do the adhesives per se. A suitable primer for steel, aluminum, acrylonitrile-butadiene-styrene, polycarbonate, polymethymethacrylate, and polyamide is a 5% solution of an acrylic resin dissolved in trichloroethylene. Polypropylene is effectively primed for hot melt adhesives according to the invention by a 5% solution of chlorinated polyolefin in toluene. An excellent primer for glass is 1% epoxy silane dissolved in butanol. Polyurethane and unsaturated polyester-glass cloth laminate are primed with a 10% solution of polyisocyanate dissolved in dichloroethylene.

The hot melt adhesive may be incorporated into the ski structure in several ways. Because the adhesive is nontacky at room temperature it is most conveniently utilized by laying a film of adhesive on a release liner in the conventional manner and rolling it up. To apply the adhesive between two elements or sections of a ski, the desired length of adhesive on the release liner is cut from the roll, peeled off the liner, placed between the parts to be assembled and trimmed if necessary. This is repeated for the other sections or elements of the ski assembly which are then clamped or placed in an appropriate mold under pressure. The assembly is then heated to activate the hot melt adhesive, then cooled and removed from the mold or unclamped. The adhesive may also include a metal mesh, strands, or powder, in which case the adhesive may be activated by induction heating. A second method is the application with a so-called glue gun which melts and ejects the adhesive. A third general method is the hot application of hot melt adhesive to one side of one section or element and allowing the adhesive to cool, and become nontacky, for later assembly by the application of heat. There are also several sources of heat for activation of the hot melt adhesive, all of which are well known. Among them are infra-red, ultrasonic, microwave, induction heating if the adhesive contains a metal in one form or another, electrical or induction if one or both parts to be joined are metal, electron beam and laser.

The use of hot melt adhesives containing an adhesion promoter to assemble skiis is a major advancement over the prior art use of epoxies and cyano acrylate adhesives because the hot melt adhesives (1) remain flexible at very low temperatures whereas the epoxies and cyano acrylates become very brittle; (2) are little effected by numerous fluctuations in temperature e.g. from 21° C. to below −30° C., (3) are much more resistant to deterioration by moisture, and (4) reduce the cost of manufacturing skiis by eliminating the relatively long cure cycle required to cure epoxies.

BRIEF DESCRIPTION OF THE DRAWING

FIG. 1 is a transverse cross sectional view of a ski in accordance with the present invention, in a disassembled state.

EXAMPLE OF THE PREFERRED EMBODIMENTS

FIG. 1 shows an exploded view of a ski according to the present invention where 1 is a top surface bearing section, 2 is a bottom surface bearing section and 3 is a core section located therebetween. The top surface bearing section is made up of a top surface layer 4 which may be an acrylonitrile-butadiene-styrene film of a decorative nature as well as a finishing nature, a hot melt adhesive stratum 7 attaching the top surface layer to an element 5 which may be a strip of aluminum alloy, a fiber-glass resin laminate or the like. The bottom surface bearing section 2 has a bottom surface layer 10 which is a sheet of ultra high density polyethylene, polycarbonate, polytetrafluoroethylene or some other low friction material, a hot melt adhesive layer 7 bonding said bottom surface layer to a semi rigid layer or strip 9 which is preferably steel, an aluminum alloy or a fiberglass-resin laminate. Sandwiched between and bonded to the top surface bearing and bottom surface bearing sections is the core section 3 affixed to the other two sections with hot melt adhesive layers 7. The core 8 per se is composed of foamed polyurethane, epoxy resin or even wood. Skis so constructed exhibit excellent resistance to temperature variations, deterioration by ultra violet light radiation and stability to exposure to very high moisture conditions as shown by the following test data.

In a tumbling type mixture, the following materials were mixed in the quantities indicated:

| | |
|---|---|
| OREVAC HM 1003 (1) | 8 kg. |
| PE 3168 (2) | 0.4 kg. |
| IRGANOX 1010 (3) | 0.4 kg. |

(1)A block polyetheramide manufactured by ATO Chimie, Courbevoie, France
(2)A 50-50 blend of carbon black and low density polyethylene manufactured by Cabot Plastics Belgium SA
(3)An antioxidant manufactured by Ciba-Geigy.

(1) A block polyetheramide manufactured by ATO Chimie, Courbevoie, France
(2) A 50-50 blend of carbon black and low density polyethylene manufactured by Cabot Plastics Belgium SA
(3) An antioxidant manufactured by Ciba-Geigy.

The materials were tumbled for about 10 minutes which resulted in thorough mixing. The batch was placed in the hopper of a conventional screw type extruder and fed through the barrel at a rate of 52 g/min while being heated to about 190° C. At approximately midway along the extruder barrel the organo silane A186 manufactured by Union Carbide Corporation was fed into the batch from a closed supply tank filled with nitrogen gas under pressure. The silane was delivered at a rate of 4.7 g/min. The A186 was beta (3, 4- epoxy cyclohexyl) ethyltrimethoxysilane. When all the ingredients were thoroughly blended and stabilized, the blend was extruded at 200° C. in the form of a ribbon 0.15 mm thick, onto a glass cloth release belt.

The properties of the foregoing hot melt adhesive formulation were evaluated by subjecting the adhesive to lap shear and 180° peel adhesion tests. The lap shear test was the standard test ASTM C 961-81 "Lap Shear Strength for Hot-Applied Sealing Compounds"; this test was carried out using the exact adhesive formulation described above and also with the same formulation with the silane adhesion promoter. The results are shown in Tables I and II with Table I involving the silane containing formulation while Table II shows the results without silane in the formulation. In both cases 2 pieces or plates of the same material were adhesively joined. The 180° peel adhesion test was carried out by first preparing polytetrafluoroethylene sheets measuring 25 mm×150 mm×1 mm. Using a hot melt extrusion gun the above sealant composition was extruded onto one surface of the painted steel plates which were then compressed onto the etched side of the polytetrafluoroethylene sheets to a thickness of 0.2 mm; the polytetrafluoroethylene overlapped about 75 mm in the lengthwise dimension. The samples were allowed to condition for a little over 4 hours at 23°±2° C. The samples, one at a time, were loaded into the tensile machine and the polytetrafluoroethylene was pulled back at 180° at a rate of 50 mm/min at 23°±2° C. until failure. The force to failure was measured in Newtons per 20 mm. The results of testing against a cyano-acrylate adhesive exposed to high humidity and UV light are shown in Table III.

Shear test samples were prepared and tested as above described and compared to samples prepared and tested in the same manner but wherein the test specimens were all exposed to an atmosphere saturated with moisture. However, here the materials adhered together were two sheets of polycarbonate measuring 25×50×4 mm instead of glass plates. In addition, a second silane was included in the humidity aging test. The startling effect that the presence of an adhesion promoter has on the durability of the adhesive joint can be readily seen in Table I.

TABLE I

| | Without Silane | A186 Silane | IMEO* Silane |
|---|---|---|---|
| Initial | 315 N/cm$^2$ | 296 N/cm$^2$ | 311 N/cm |
| 1000 Hr Hi-humidity | 0 N/cm$^2$ | 315 N/cm$^2$ | 180 N/cm$^2$ |

*4, 5-dihydro-1-[3-(triethoxysilyl)propyl]- imidazole sold by Dynamit Nobel present in an amount of 0.8 kg per 8 kg of OREVAC HM 1003

After 1000 hours in high humidity the non-silane containing hot melt adhesive essentially had lost all of its adhesion while the A186 containing adhesive had become even stronger. The IMEO containing adhesive had retained about 60% of its original adhesive strength as measured in shear.

The inherent shear strength of the hot melt adhesive itself was evaluated with numerous adherends even without incorporating an adhesion promoter in the adhesive; the results are shown in Table II. However, all the surfaces to be adhered were coated with a primer coat, except the galvanized steel samples, as follows:

| Substrate | Primer |
|---|---|
| steel | modified acrylic |
| aluminum | modified acrylic |
| ABS | modified acrylic |
| polycarbonate | modified acrylic |
| PMMA | modified acrylic |
| polyamide | modified acrylic |
| polypropylene | chlorinated olefin |
| glass | epoxy resin based |
| polyurethane | polyisocyanate based |
| glass/polyester | polyisocyanate based |
| galvanized steel | none |

TABLE II

Shear Values N/cm$^2$

| Substrates: | PMMA | PC | ABS | PA | PP | P ureth. |
|---|---|---|---|---|---|---|
| Conditions | | | | | | |
| RT | 223 | 243 | 210 | 185 | 184 | >170 |
| (initial) | AR | AR | AR | AR | AR | SF |
| 50° C. | 205 | 220 | 208 | 143 | 97 | >75 |
| | AR | AR | AR | AR | AR | SF |
| 80° C. | 125 | 132 | 121 | 85 | 0 | >30 |
| | AR | AR | AR | CR | | SF |
| After 2 wks | 215 | 210 | 200 | 197 | 192 | >138 |
| in UV DRY | AR | AR | AR | AR | AR | SF |
| After 2 wks | 212 | 200 | 224 | 163 | 181 | >152 |
| in oven at 80° C. | AR | AR | AR | AR | AR | SF |

| Substrates: | PTFE Etched | Painted Panel | Anodised Alum-inum | Milfinished Aluminum | Galv. Steel |
|---|---|---|---|---|---|
| Conditions | | | | | |
| RT | 120 | 134 | 111 | 72 | 186 |
| (initial) | AR/SF | AR | AR | AR | AR |
| 50° C. | >54 | 127 | 58 | 73 | 114 |
| | SF | AR | AR | AR | AR |
| 80° C. | >57 | 48 | 40 | 54 | 108 |
| | SF | AR | AR | AR | AR |
| After 2 wks | >129 | 165 | 130 | 66 | 188 |
| in UV DRY | SF | AR | AR | AR | AR |
| After 2 wks | >110 | 196 | 117 | 74 | 176 |
| in oven at | SF | AR | AR | AR | AR |

TABLE II-continued

| Shear Values N/cm$^2$ |
|---|
| 80° C. |

PPMA = polymethylmethacrylate
PC = polycarbonate
ABS = acrylonitrile-butadiene-styrene
PA = polyamide
PP = polypropylene
P Ureth. = polyurethane
PTFE = polytetrafluoroethylene
AR = adhesive failure or rupture
CR = cohesive failure
SF = substrate failure The high shear values are clear. The bond was even stronger than the substrate or adherend in the case of polyurethane and etched polytetrafluoroethylene. The one exception was polypropylene at 80° C.

Peel adhesion strength after prolonged exposure to moisture is also important to the durability of skiis assembled with an adhesive, and critical with respect to joining the boot pad 12 directly to the top surface of a ski or when the pad is joined to the painted metal base of a binding. To test this property the adhesive according to the invention, which included A186 adhesion promoter, was compared to a cyano-acrylate adhesive used commercially to attached boot pads in the aforedescribed peel adhesion test. Etched polytetrafluoroethylene sheets or films were adhered to painted steel plates. The results are shown in Table III.

TABLE III

| Humidity Aging | Hot Melt Adhesive | Cyano-acrylate |
|---|---|---|
| None | 160 N/20 mm | 50 N/20 mm |
| 4 days | 180 N/20 mm | 40 N/20 mm |
| 30 days | 200 N/20 mm | 25 N/20 mm |

Even before any humidity aging, the invention assembly was better than 3 times stronger and by the time the both sets of samples were aged 30 days in a humid environment the invention assembly was 8 times stronger in peel than was the cyano-acrylate adhesive bonded assembly.

It should be understood that although for simplification the assembly of skiis according to the invention is discussed and claimed in terms of joining a top surface bearing section, a bottom surface bearing and a core section, the invention is applicable to and includes adhesively joining the several parts that may make up each individual section.

What is claimed is:

1. A laminated ski having a top surface bearing section, a bottom surface bearing section, a core section therebetween, wherein a bonding layer is provided between the top and bottom surface bearing sections and said core section, wherein said bonding layer is a hot melt adhesive, wherein said hot melt adhesive contains an predetermines amount of an adhesion promoter, and a boot pad adhesively attached to the base of said top surface bearing section with a hot melt adhesive containing an predetermined amount of an adhesion promoter.

2. The laminated ski of claim 1 wherein said hot melt adhesive is one based on a thermoplastic polymer selected from the group consisting of polyester, polyamide, polyesteretheramide, polyetherester, polyetheruerethane, polyesteramide, polyetheramide, copolymers of ethylene-vinylacetate, and mixtures thereof.

3. The laminated ski of claim 2 wherein said adhesion promoter is an organo functional silane and is present in an amount of from 0.05 to 20 parts by weight per 100 parts by weight of said polymer.

4. The laminated ski of claim 2 wherein said adhesion promoter is an epoxy resin and is present in an amount of from 0.5 to 200 parts by weight per 100 parts by weight of said polymer.

5. The laminated ski of claim 2 wherein said adhesion promoter is a phenolic resin and is present in an amount of from 0.5 to 200 parts by weight per 100 parts by weight of said polymer.

6. The laminated ski of claim 2 wherein said hot melt adhesive includes 0.05 to 10 parts by weight of an antioxidant and 0.5 to 200 parts by weight of filler material per 100 parts by weight of said polymer.

7. A laminated ski according to claim 2 wherein the surfaces to be bonded of said top and bottom surface bearing sections, core sections, and boot pad are coated with a primer prior to application of said hot melt adhesive.

8. A laminated ski having a top surface bearing section, a bottom surface bearing section, and a core section therebetween, wherein a bonding layer is provided between the top and bottom surface bearing sections and said core section, wherein said bonding layer is a hot melt adhesive, wherein said hot melt adhesive contains and predetermined amount of an adhesion promoter, wherein said hot melt adhesive is one based on a thermoplastic polymer selected from the group consisting of polyester, polyamide, polyesteretheramide, polyetherester, polyetheruerethane, polyesteramide, polyetheramide, copolymers of ethylene-vinylacetate, and mixtures thereof, wherein said hot melt adhesive includes 0.05 to 10 parts by weight of an antioxidant and 0.5 to 200 parts by weight of filler material per 100 parts by weight of said polymer, and wherein the surfaces to be bonded of said top and bottom surface bearing sections, and core sections, are coated with a primer prior to application of said hot melt adhesive.

* * * * *